US006098690A

United States Patent [19]

Robichaud

[11] Patent Number: 6,098,690

[45] Date of Patent: Aug. 8, 2000

[54] TAPE DISPENSING SYSTEM WITH AUTOMATIC BACKING REMOVAL

[76] Inventor: Andre M. Robichaud, 5 Center Rd., Amherst, N.H. 03031

[21] Appl. No.: 09/105,415

[22] Filed: Jun. 26, 1998

[51] Int. Cl.[7] ..... B44C 7/00

[52] U.S. Cl. ..... 156/577; 156/579

[58] Field of Search ..... 156/574, 577, 156/579

[56] References Cited

U.S. PATENT DOCUMENTS

| | | | |
|---|---|---|---|
| 3,077,919 | 2/1963 | Kruger . | |
| 3,369,952 | 2/1968 | Reiger . | |
| 3,969,181 | 7/1976 | Seabold . | |
| 4,089,730 | 5/1978 | Mahn . | |
| 4,115,180 | 9/1978 | Scalia . | |
| 4,240,867 | 12/1980 | Diegel . | |
| 4,574,030 | 3/1986 | Pilcher . | |
| 4,648,935 | 3/1987 | Brown . | |
| 4,718,971 | 1/1988 | Summers . | |
| 4,849,064 | 7/1989 | Manusch et al. . | |
| 4,851,076 | 7/1989 | Manusch et al. . | |
| 4,880,490 | 11/1989 | MacIntyre . | |
| 4,882,007 | 11/1989 | Lengen et al. | 156/574 X |
| 4,891,090 | 1/1990 | Lorincz et al. . | |
| 5,178,717 | 1/1993 | Rodriquez . | |
| 5,310,445 | 5/1994 | Tucker . | |
| 5,725,726 | 3/1998 | Yu . | |

*Primary Examiner*—Mark A. Osele
*Attorney, Agent, or Firm*—Scott J. Asmus; Vernon C. Maine

[57] ABSTRACT

The invention in the simplest form is a tape dispenser with automatic backing removal. The dispenser is specially designed for foil tape, and employs a rubber band drive connecting the feeder roller and the takeup roller to ensure that the tape is dispensed smoothly. A cutting blade assembly allows the operator to quickly and easily tear off a length of tape, while retaining the backing material on the takeup roller.

16 Claims, 11 Drawing Sheets

TAPE DISPENSING SYSTEM WITH AUTOMATIC BACKING REMOVAL

BACKGROUND OF THE INVENTION

1. Field of the Invention

The present invention relates to a tape dispensing system, specifically, a tape dispensing device with automatic backing removal, and more specifically, a tape dispensing system apparatus for foil tape.

2. Background Art

Foil tape is a metallic tape, with an adhesive coating on one side, and a protective backing covering the adhesive until the tape is ready to be used. This type of tape is commonly used to seal joints and seams of piping and foil jacketing insulation. The tape prevents the introduction of moisture and foreign debris into the system, and is used extensively in the Heating Ventilation Air Conditioning (HVAC) industry and for the ducts in Forced Hot Air (FHA) and Air Conditioning systems.

The metal insulated pipes used as chimneys in Forced Hot Water (FHW) heating systems, as well as wood, propane, coal, and pellet stoves also use the foil tape to seal the pipe sections. And, the tape is used during maintenance and cleaning procedures to seal inspection holes and re-seal pipes. The foil tape aids in preventing carbon monoxide (CO) from entering into the house, as well as preventing foreign debris and moisture from entering the pipes.

Foil tape has a protective backing that covers an adhesive layer on one side of the tape. When the backing is removed, the tape adheres to the desired surface. However, the process of removing the backing material is time consuming and difficult. The comer of the tape must be bent and otherwise manipulated to separate the backing from the adhesive. An alternative method is to "pick" at the backing with a fingernail or pointed device in an attempt to separate the backing. These manual methods expend time and resources that can account for a significant dollar value in a construction project.

The manual method also requires the user to use both hands. Thus, the user has to stop the current job, put down all tools and supplies, remove work gloves or other clothing articles, and then try to separate the backing. This task becomes ever more difficult in adverse weather conditions. In cold climates, hand and finger dexterity is greatly decreased, requiring more time to remove the backing and subjecting the user to frostbite. In warm climates perspiration tends to make the tape slippery and more difficult to handle.

In addition, the tape can be damaged in the backing removal process. The tape may stick to itself, and because the tape has a highly adhesive compound, would render that portion of the tape unusable. This back-curl tendency is a specific aspect of foil tape, and increases the amount of tape wasted on a job. The foil tape is also subject to damage if bent or twisted during the backing removal process. The metallic based tape is similar to aluminum foil in some respects, and if wrinkled or otherwise damaged cannot be re-shaped into a smooth surface.

In addition to the problems in removing the backing, there is also considerable waste from the pieces of backing scattered around the work site. The waxed paper pieces of backing material create a messy workplace and have to be manually picked up and disposed. The pieces of backing paper also increase the likelihood of a fire hazard, especially around a busy worksite.

From a business viewpoint, the difficult process of removing the backing from the foil tape translates into increased expenses and lower profit margins. The additional time required to remove the backing adds to the overall time a project requires to complete. The portion of tape that are damaged during the removal process increase the amount of required supplies. The additional time and labor involved in picking up the pieces of backing material is directly proportional to profit margin. And, the expenses involved in safety and fire insurance increases if a worksite experiences a fire caused by the backing paper.

In order to reduce the aforementioned problems, attempts have been made to produce an efficient and easy-to-use dispensing unit. Tape dispensing devices have been around for many years, with numerous variations. Some units are specifically designed for the differing tapes of tapes, such as scotch tape, duct tape, adhesive backed tape, packing tape, and correction tape. Generally, these devices allow the user to extract a length of tape from a tape reel and tear off a desired length. Some of these dispensing units have been attempted for foil tape, but have significant shortcomings.

One such tape dispenser is described in U.S. Pat. No. 3,969,181. This gun-shaped transfer adhesive dispensing apparatus uses a trigger release mechanism that engages a serated disc. The adhesive tape is pulled or drawn out from the tape roll over an application roller. The takeup roller accepts the liner backing that is partially drawn by the exposed adhesive. This particular dispensing apparatus does not use a belt drive mechanism, and does not have many of the features and advantages of the present invention.

U.S. Pat. No. 4,240,867 is described as a dispenser for adhesive backed foil tape, more specifically, foil tape used in the construction of stained glass items. The adhesive foil is drawn from a spool, over a series of rollers and guides, and to a peel blade that separates the tape from the backing. The backing is fed under a guide and over the top of the spool, where it eventually is directed out the back of the spool. The peel blade is designed so that the adhesive foil passes through, but the backing layer is stripped away. The present invention does not incorporate a peel blade, and has additional features and applications not disclosed in this patent.

The tape dispensing device of U.S. Pat. No. 4,574,030 is specifically intended for the adhesive foil tape with protective backing. The device has an automatic takeup roller to retain the backing material after it is separated from the tape, and has an integrated cutter to tear the tape at the intended location. This device has a rubout plate to smooth the tape as it is applied to the surface and multiple handles. It also utilizes springs, a rubber pad, and a swing arm to retain the tension on the takeup roller and evenly distribute the tape. The unit is particularly designed for placing tape on flat surfaces and is difficult to operate, requiring the two hands to operate.

What is needed is a foil tape dispenser that can remove and retain the protective backing. The device should be easy to operate and quickly allow the operator to extract the desired length of tape. This unit should be built with a rugged design that can take the abuse of a worksite. It should allow easy access to internal components and permit a fast replacement of a tape spool and easy discharge of the backing paper.

SUMMARY OF THE INVENTION

The present invention has been made in consideration of the aforementioned background. It is therefore an object of the present invention to provide a foil tape dispensing apparatus with an automatic system for removing the backing material.

An object of the present invention is to provide a foil tape dispenser that automatically removes the backing paper without expending time and effort in manual separation procedures.

Another object of the invention is to provide a dispenser that is easy to operate, reducing the time it normally takes to dispense lengths of foil tape.

Another object of the invention is to minimize waste from a worksite by automatically retaining the backing paper on a spool of the dispenser. When the spool is full, the entire length of backing paper can be efficiently disposed of in a single step.

Another object of the invention is to reduce or eliminate the amount of wasted tape due to the foil tape 'curling back' onto itself, rendering that portion of the tape unusable.

A further object of the invention is to minimize the amount of tape damaged from creasing, folding, and denting, by protecting the roll and dispensing the tape via the dispenser.

Another object of the invention is to use a rubber band drive as the internal mechanism that connects the feeder roller to the take-up roller. The rubber band allows the operator to quickly and smoothly extract the required length of tape without complex gear mechanisms. The rubber bands are inexpensive components and easily replaced.

A further object of the invention is the use of a take-up roller to retain the backing paper after the separation from the foil tape.

Another object of the invention is to provide a dispenser with a rubber roller that creates friction control and allows the tape distribution to occur smoothly and without slippage.

A further object is to provide a plastic roller as a guide for the tape before the tape and the backing material are separated.

An additional object of the invention is to allow the invention to be mounted with a belt hook and clipped or strapped to the operator.

Yet another object of the invention is to introduce a sturdy dispenser that has a solid frame and simple internal mechanisms. The present invention uses rollers and belts within a metal frame, providing reliable and durable operation.

Yet a further object of the invention is to allow the operator to use the invention with a single hand by providing a means of mounting the invention. Once mounted, the operator can extract the desired length of tape and easily tear it with a single hand.

A further object of the invention is to provide a hinged access panel to allow easy access to the internal components for replacing spools, discarding backing paper, cleaning the rollers and replacement of components.

Yet another object of the invention is to provide a drive protective cover around the rubber band drive mechanisms to protect the drive area from debris and damage.

A further object of the present invention is to provide an access panel with a simple and easy-to-operate knob.

Yet an even further object of the invention is to color the dispenser to easily find it if misplaced. The device can also incorporate advertising or design features for aesthetic appeal.

A further object of the invention is to provide a handle on the tape dispenser that is easy to grasp and can be held with one hand.

Yet a further object of the invention is to provide a mounting means so that the tape dispenser can be easily mounted as a stationary dispenser.

An object of the invention is to provide a dispensing apparatus for adhesive tape having a protective backing. The present invention has a frame structure with a supply reel rotatably mounted to the frame, wherein the supply reel accepts a spool of tape. A guide roller is rotatably attached to the frame, and the guide roller accepts a section of tape from the spool. A feeder roller is rotatably attached to the frame, and the feeder roller accepts a section of tape after the protective backing is separated from the section of tape. A takeup roller is also attached to the frame for receiving the protective backing. There is a rubber band drive connecting the feeder roller with the takeup roller.

Another object of the invention is to provide a dispensing apparatus where the frame has an access panel hingedly attached to the frame.

Yet another object of the invention is to provide a dispensing apparatus that has a handle attached to the frame.

Yet a further object of the invention is to provide a dispensing apparatus where the handle is removable.

A further object of the invention is to provide a dispensing apparatus having a cutting blade connected to the frame.

Another object of the invention is to provide a dispensing apparatus with a cutting blade, where the cutting blade is adjustable. The cutting blade can be set at different angles and can have different types of cutting blades that are easily interchanged.

Still a further object of the invention is to provide a dispensing apparatus where the takeup roller and the feeder roller have an outer surface made of rubber.

Another object of the invention is to provide a dispensing apparatus that has a means for controlling the tension of the supply reel.

A further object of the invention is to provide a dispensing apparatus having a belt mountable hook attached to the frame.

Yet a further object of the invention is to provide a dispensing apparatus where the belt mountable hook engages a rafter mount that can be used to fixedly attach the dispenser to the rafter.

An even further object of the invention is to provide a dispensing apparatus that engages a surface mount platform, securing the dispensing apparatus to the platform.

A further object of the invention is to provide a dispensing apparatus that engages a frame mount, securing the dispenser to the frame mount.

Yet another object of the invention is to provide a dispensing apparatus where the frame has elongated slits.

A still further object of the invention is to provide a dispensing apparatus constructed from stainless steel, steel, aluminum, or plastic.

Yet a further object of the invention is to provide a dispensing apparatus where the feeder roller and the takeup roller are identical in size.

Still another object of the invention is to provide a dispensing apparatus where both the feeder roller and takeup roller have a threaded inner shaft, an insert surrounding said shaft, and a rubber sleeve encasing said insert.

A still further object of the invention is to provide a dispensing apparatus where the feeder roller insert has a groove and the takeup roller insert has a groove, and the rubber band is positioned in the feeder roller insert groove and in the takeup roller insert groove.

Another object of the invention is to provide a dispensing apparatus where the takeup roller insert groove is deeper than the feeder roller insert groove. This creates a differential in the revolutions per minute (RPM) between the takeup roller and the feeder roller when being turned by the rubber band.

An object of the invention is to provide a dispensing apparatus having a frame, a supply reel rotatably mounted to the frame, where the supply reel accepts a spool of adhesive tape with protective backing. The feeder roller is rotatably mounted to the frame, and the feeder roller accepts a section of tape from the spool, and the protective backing separates from the section of tape. The takeup roller is also rotatably mounted to the frame for receiving the protective backing. The dispenser has a rubber band drive connecting the feeder roller with the takeup roller, and there is a means of establishing a rate differential between the takeup roller and the feeder roller.

Yet a still further object of the invention is to provide a dispensing apparatus where the rate differential means includes a smaller dimension takeup roller.

And yet another object of the invention is to provide a dispensing apparatus where the takeup roller insert groove connects to the rubber band, and the feeder roller insert groove connects to the other end of the rubber band, and where the combination of the size of the rubber band, the depth of the takeup roller insert groove, and the depth of the feeder roller insert groove establishes the rate differential.

A further object of the invention is to provide a dispensing apparatus where the supply reel comprises a shaft assembly fixedly attached to the side panel, a shaft guide, a feeder spool, a washer, and a tension spring controlled by a tension dial.

Another object of the invention is to provide a dispensing apparatus as in claim 1, wherein the frame is made with 18 guage cold roller steel.

Still a further object of the invention is to provide a dispensing apparatus for adhesive tape with protective backing, where the dispenser comprises a frame with an access panel, a side panel and a front panel. The access panel is hingedly attached to the frame, with an access hole to permit the panel to close around the tape and supply reel. The supply reel is fixedly attached on one side to the side panel. The other side of the supply reel accepts a spool of tape, and the supply reel secures the spool to the reel with a fastener. There is a guide roller, a feeder roller, and a takeup roller attached between the side panel and the front panel. There is also a rubber band drive connecting the feeder roller with the takeup roller, where the protective backing collects on the takeup roller. The dispenser also has a handle attached to the frame.

Other objects, features and advantages are apparent from description in conjunction with the accompanying drawings.

DESCRIPTION OF THE PREFERRED EMBODIMENT

Figures 1A, 1B, 1C:
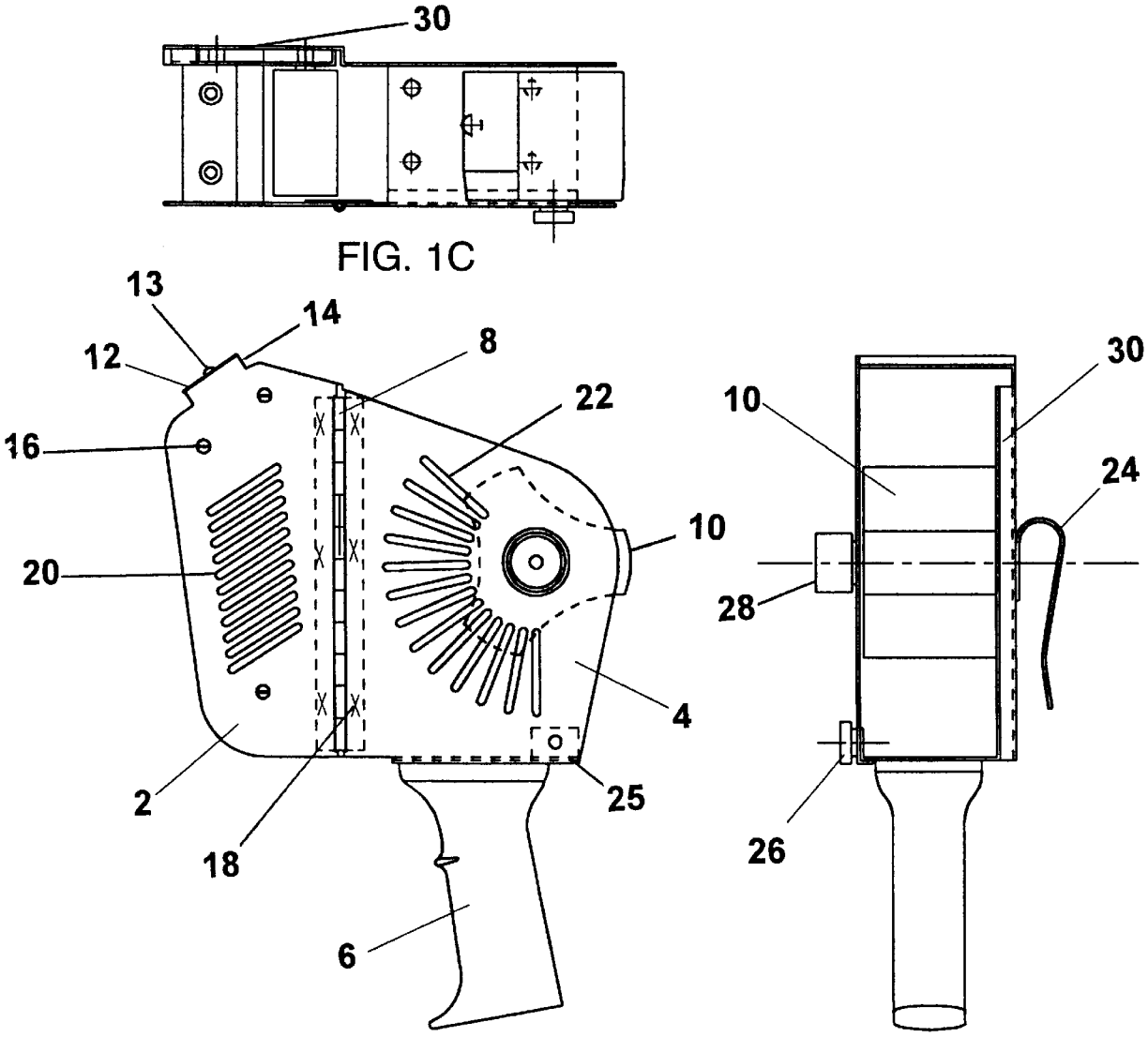
FIG. 1A is a left side perspective view of the tape dispenser.
FIG. 1B is an end view perspective of the tape dispenser.
FIG. 1C is a top view perspective of the tape dispenser.

FIG. 1(*a*) is a left side view of the tape dispenser, showing the main exterior components, including, the removable handle 6, the access panel 4, the hinge 8, and the front plate 2. The handle 6 is designed for easy gripping, and is mounted to the bottom of the frame. The front plate 2 is attached to the hinge 8 by spot welds 18. It is secured in place by hex screws 16 that engage the threaded shaft of the inner pin 31, shown in detail in FIG. 7. The access panel 4 is hingedly attached by hinge 8 on one side. When closed, it is fastened in place by an access panel knob 26 engaging the access panel knob receptacle 25.

The cutter assembly 12 is secured by screws 13 to a small plate 14 formed or welded between the right front plate and the left front plate. In the preferred embodiment the small plate 14 is attached to the right front panel, permitting the panels to be separated, thus allowing access to the rollers and belt drive assembly. The entire right side of the unit, encompassing the access panel and the left front plate can be completely removed once the hex screws 16 and access panel knob 26 are removed.

The handle is an industry standard, having four guide pins and a center lug that is fits through a hole in the frame and is secured to the frame by a nut. The four guide pins also fit through four holes in the frame and prevent the handle from turning once fastened in place. An orientation layout of the holes can be seen in the mounting assembly of FIG.'s 10 and 11. The placement of the center hole and pins is illustrated.

In this embodiment, the access panel 4 and front panel 2 are affixed to the left side of the dispenser, with the side panel on the right side. It is within the scope of the invention to configure the dispenser with the access panel 4 and front panel 2 on the right side, and the side panel on the left side.

The supply reel 10 resides behind the access panel 4, but is visible through the rear slits 22 in the access panel 4. In the preferred embodiment, the supply reel 10 extends slightly beyond the access panel 4. The access panel 4 and right side panel are shortened to reduce the overall weight of the device, but subject the exposed foil tape to possible damage. A variation of the present design extends the access panel 4 and right side panel to shield the supply reel 10 and foil tape from damage. Other protection embodiments, including a separate shield are all within the scope of the invention.

In the preferred embodiment, the plates are made of 18 guage cold roller steel. Plastic is also a preferred construction material that would provide a cost effective and sturdy dispenser. Other materials and dimensions are within the scope of the invention. There are front slits 20 and rear slits 22 that reduce the overall weight of the device in the steel version, allow the user to inspect the unit, and can be designed for aesthetic appeal.

In FIG. 1(*b*), the back end of the dispenser is illustrated. The belt mountable hook 24 is shown, as well as the access panel knob 26 and tension control dial 28. The access panel knob 26 secures the access panel 4 to the unit. The access panel 4 is attached to the unit by the spot welded hinge 8, and allows easy access to the supply reel 10 chamber when the access panel 4 is opened. In the preferred embodiment, the knob 26 uses a threaded screw as the fastening member, however other types of fastening are within the scope of the invention, including snaps, latches, hooks, Velcro, and magnets.

The supply reel 10 is visible from the back end of the unit, and there is no back cover in the preferred embodiment. It is within the scope of the invention to place a cover or shield on the back end to protect the tape from damage and prevent debris from entering into the dispenser. It is also within the scope of the invention to lengthen the access panel and right side panel to provide protection for the tape.

The belt mountable hook 24 can secure the tape dispenser to the user's belt or work apron, allowing the user to travel around the worksite with both hands free. The hook is designed to operate in conjunction with the portable rafter frame shown in FIG. 9.

A top view perspective is revealed in FIG. 1(*c*). This shows the guide cover plate location on the right side of the dispenser, as well as the orientation of the roller assemblies.

Figure 2:
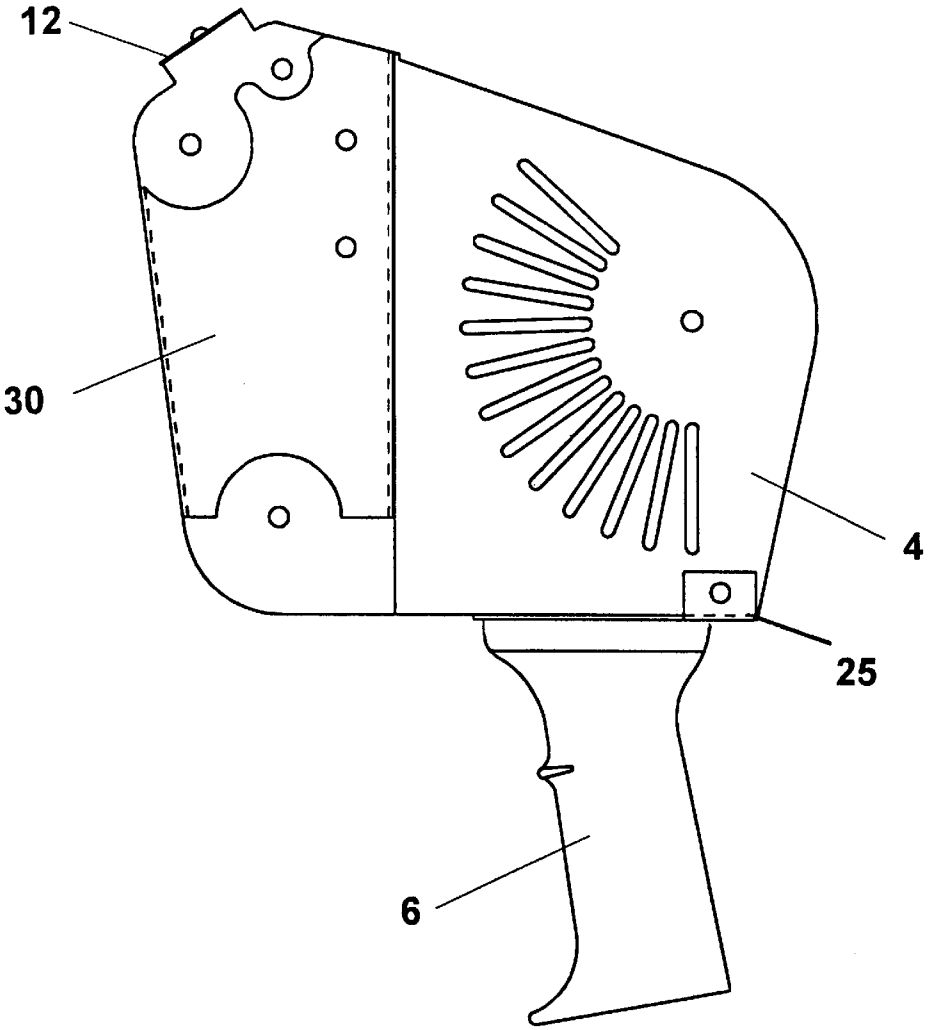
FIG. 2 is an internal left side view showing the internal belt drive cover plate.

FIG. 2 illustrates a further left side perspective of the invention showing the internal rubber band drive cover 4. This cover mounts to the inner side of the right plate and covers the rubber band assembly depicted in FIG. 4. The rubber band drive cover 4 is affixed to the inner surface of the right plate by screws in the preferred embodiment to permit the cover to be removed to replace the rubber band.

Figure 3:
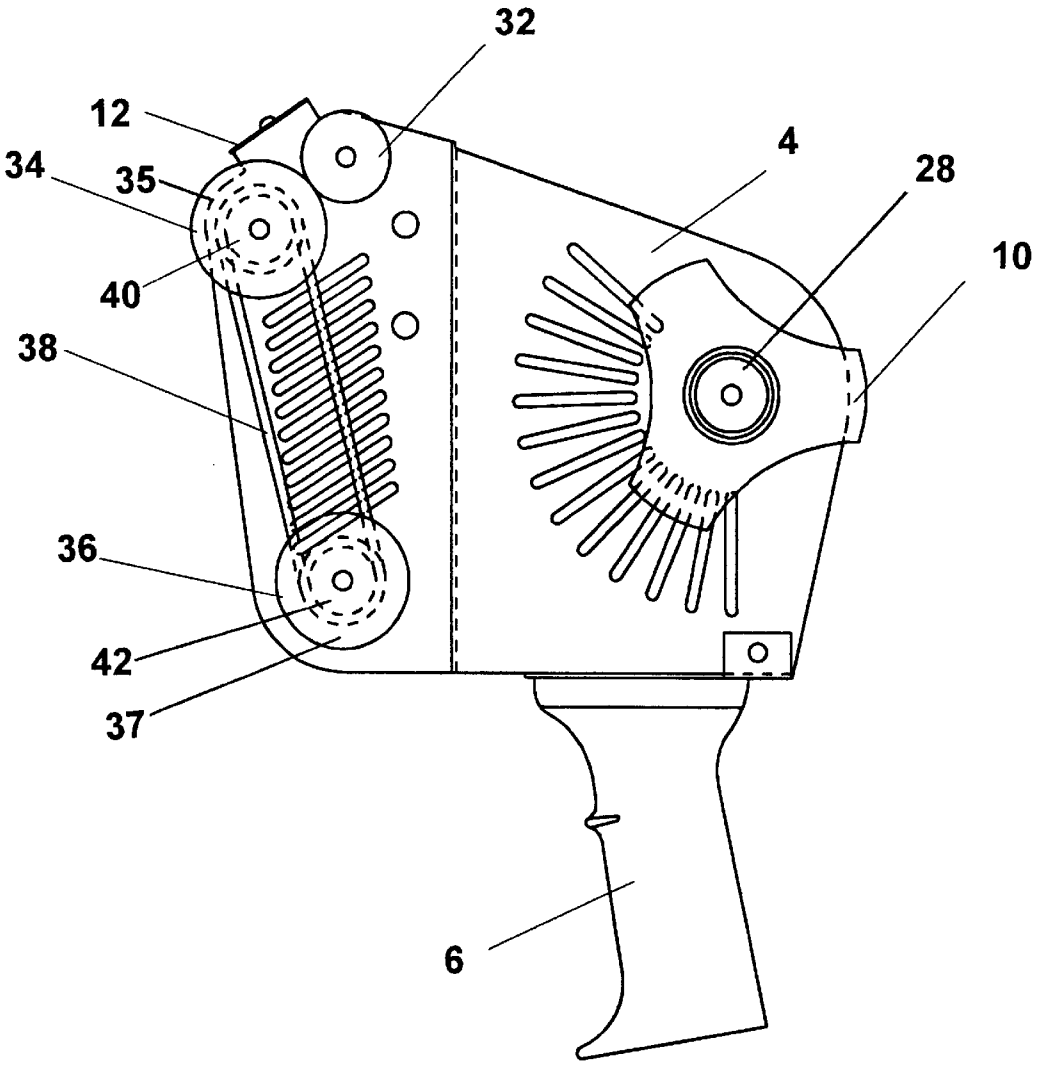
FIG. 3 is an internal left side illustration depicting the inner roller components.

FIG. 3 is a left side perspective illustrating the internal components of the tape dispenser. The supply reel 10 is shown, primarily encased behind the access panel 4. In the preferred embodiment a standard supply reel 10 is used, and secured to the right side panel. This permits an industry standard tape spool to be placed onto the supply reel, although other sized supply reels are within the scope of the invention.

The belt drive assembly is depicted, wherein the rubber band 38 interconnects; the feeder roller 35 and the takeup roller 37. As shown, the rubber band 38 contacts the roller insert 40, 42, which is shown in more detail in FIG.'s 4 and 8. Both the takeup roller and the feeder roller are the same size, to allow even distribution of the foil tape and removal of the backing material.

Figure 4:
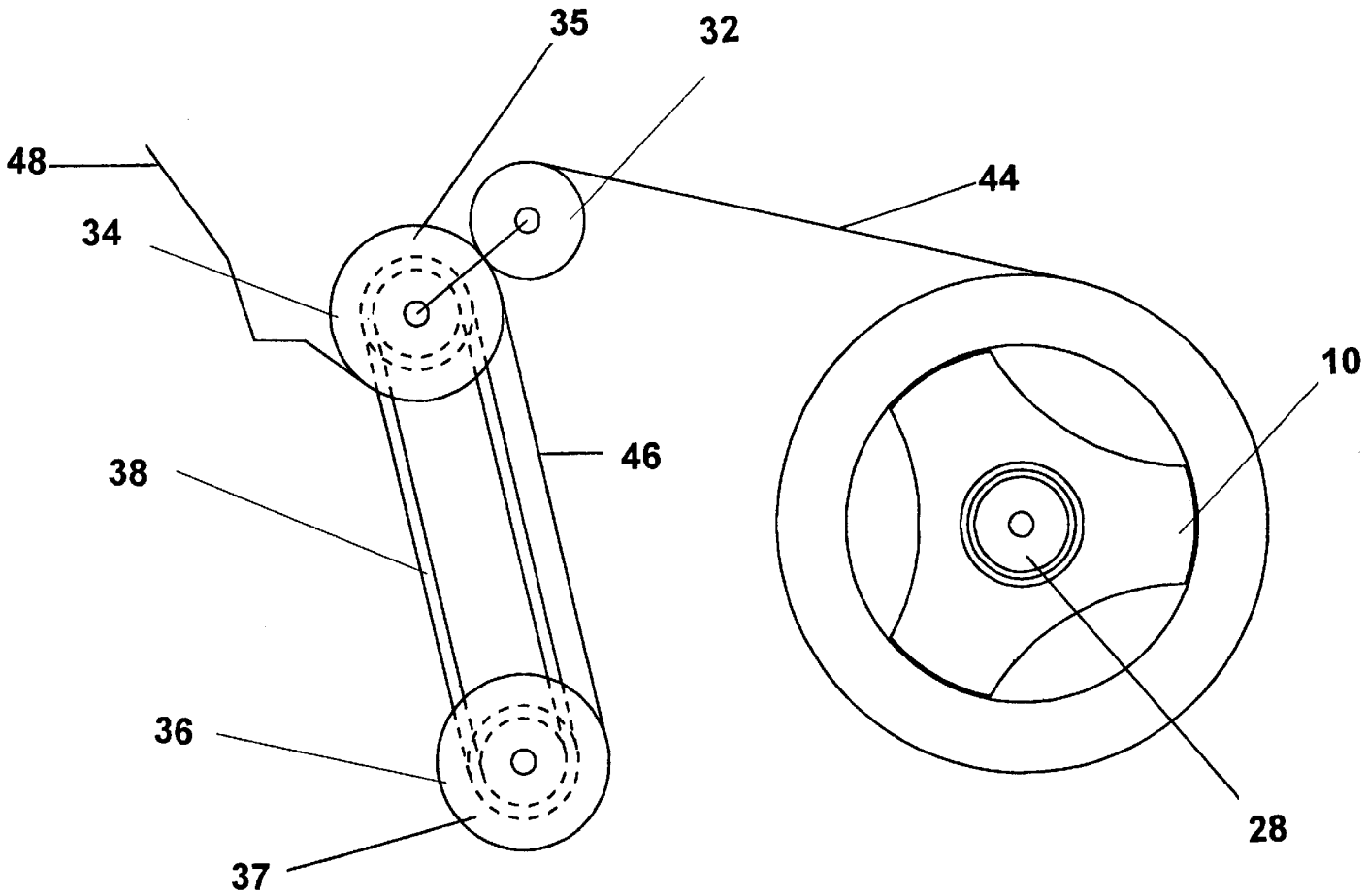
FIG. 4 shows the foil tape path, including the backing material separation and storage.

In FIG. 4, the dispensing scheme is revealed, wherein the adhesive backed foil tape resides on the supply reel. The tape goes over the guide roller where the separation process occurs. The backing material is drawn away from the tape and towards the takeup roller. The foil tape is directed under the rubber feeder roller and out of the tape opening. The cutting assembly 12 can be used to tear the tape at the desired length.

The rubber band drive 38 interconnects the takeup roller 36 and the feeder roller 34 and maintains proper tension on the tape as it is removed from the dispensing apparatus. Tension and ratio are determined in part by the depth of the groove 41 on the takeup and feeder roller, illustrated in FIG. 7, along with the size of the rubber band 38, and the tension control dial 28.

The cutter assembly 12 is illustrated in FIG.'s 5(*a*). A side view of the cutter assembly is shown as a top view in FIG. 5(*a*). The top view shows the serrated teeth 50 of the cutting blade. In the preferred embodiment a double-sided cutting blade is used, with one flat cutting edge 51 and an angled cutting edge 53. There are situations, especially if the dispenser is fixedly mounted, where the flat edge is the optimal cutting surface. Typically, the angled cutting edge 53, is the optimal cutting surface when the portable dispenser is used to lay the foil tape onto the desired object.

The fastening holes 52 are designed to permit the cutting blade to be replaced, adjusted, and switched between the angled and flat edge. The blade can also be adjusted to different angles by securing the screws off center in the oversized holes 52. This allows the tape dispenser to tear the tape at various angles.

The angled blade may also help when tearing the tape with a single motion because one side of the cutting blade contacts the tape first, allowing easy tearing without excessive force. The angling can be optimize for the user depending on how the operator uses the dispenser. Typically, right handed operators turn the dispenser in a clockwise manner, with the right edge beginning the tearing motion. An angled blade that increases the right edge contact point would assist the user in a simple cutting motion.

Figure 5B:
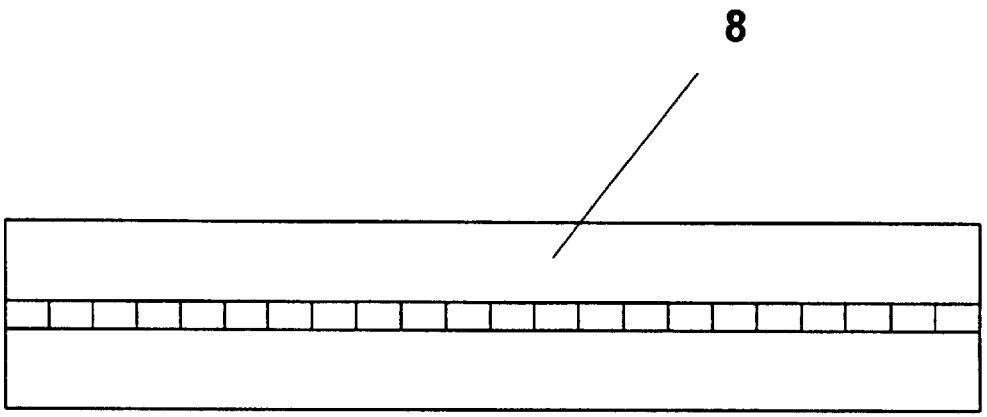
FIG. 5B depicts the hinge.
Figure 5A:
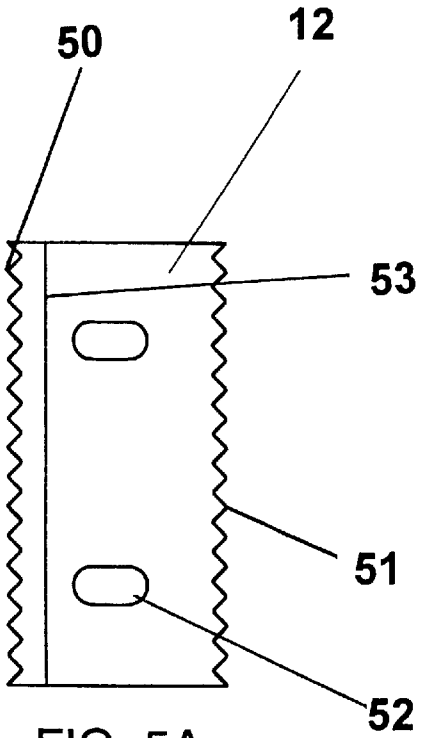
FIG. 5A is a detailed illustration of the cutter assembly, top perspective.

The hinge assembly is depicted in FIG. 5(*b*), and is fastened to the device in the preferred embodiment by tack welds. The hinge can be mounted in any manner that is cost-effective and practical, including screws, bolts, and welded seams. In the preferred embodiment, a full-length hinge is used as the junction between the access panel and the front panel. Other types of hinging or flexible interfaces are within the scope of the invention. The invention can employ separate hinge structures, plastic hinges, or merely a flexible plastic or similar seam. The overall function of the hinge is to allow the operator access to the tape spool, and various interfaces are permissible.

Figures 6A, 6B, 6C, 6D, 6E, 6F, 6G:
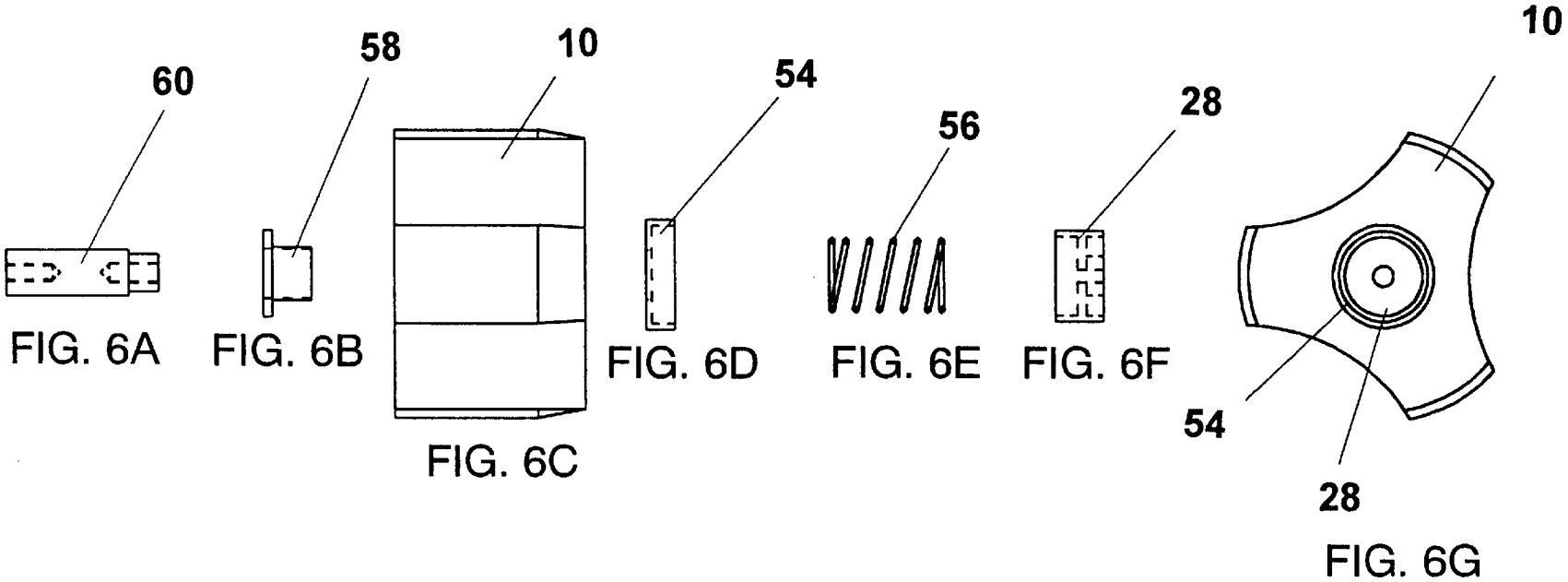
FIG. 6A is a side and exploded view of the feeder spool assembly.
FIG. 6B is a side and exploded view of the feeder spool assembly.
FIG. 6C is a side and exploded view of the feeder spool assembly.
FIG. 6D is a side and exploded view of the feeder spool assembly.
FIG. 6E is a side and exploded view of the feeder spool assembly.
FIG. 6F is a side and exploded view of the feeder spool assembly.
FIG. 6G is a side and exploded view of the feeder spool assembly.
Figure 7A:
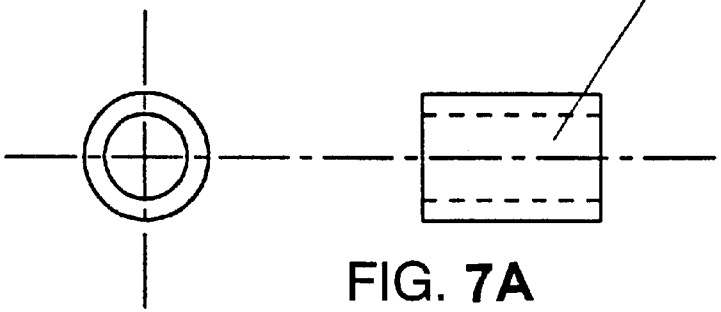
FIG. 7A depicts the rubber sleeve of the roller assemblies.
Figure 7B:
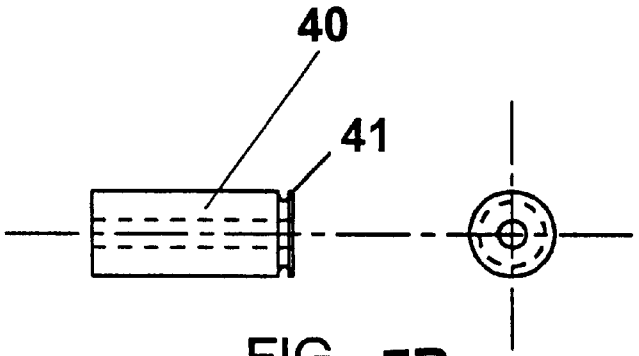
FIG. 7B depicts the insert of the roller assemblies.
Figure 7C:
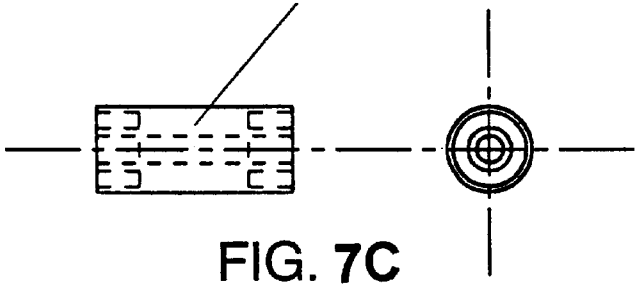
FIG. 7C depicts the guide roller assembly.
Figure 7D:
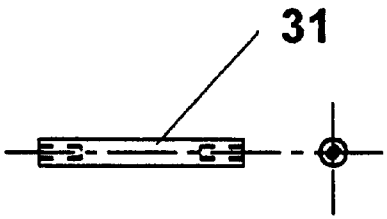
FIG. 7D depicts the inner pin.

In FIG. 6, a frontal view of the supply reel 10 is shown, as well as a detailed break-out. In the preferred embodiment a three-prong supply reel 10 is used, although any type of spool that would accept the tape spool is within the scope of the invention. The size of the supply reel 10 is set to accept the industry standard tape spool, but other size supply reels 10 can be used with the dispenser for other size tape spools.

The feeder spool is comprised of a threaded inner shaft assembly 60 that is housed within a shaft guide 58. The shaft assembly and guide can be metal, plastic, or similar material. The shaft assembly and shaft guide reside within the feeder spool. A washer 56 is employed against the inner side of the tape spool and interacts with the tension spring 54 to put lateral pressure on the spool. The spring pressure is controlled by tension dial 28. Clockwise rotation of the tension dial exerts a greater force on the washer, which in turn exerts a greater restrictive force on the feeder spool. The dial size is designed to be large enough to easily grasp and turn by the operator, but small enough to fit within a cut-out of the access panel. The access panel has a cutout for the dial so that the dial protrudes beyond the access panel after the panel is closed.

The supply reel 10 rotates about the shaft assembly and permits the foil tape to be dispensed. The tension spring 56 provides the necessary force to restrict the tape flow so that the tape is smoothly and evenly drawn from the dispenser. In the preferred embodiment, the shaft assembly 60 is secured to the inner wall of the right side panel by a screw. Other fastening means are within the scope of the invention.

Referring to FIG. 7, the roller construction is depicted. Both the feeder roller and the takeup roller are constructed similarly in the preferred embodiment. A rubber sleeve 35, 37 encases an insert 40, 42 to form the roller assemblies. The insert 40, 42 is longer that the rubber sleeve, allowing the rubber band 38 to engage the insert portion 40, 42 of the roller assemblies at the groove 41. The rubber sleeve 35, 37 portion interacts with the foil tape and backing material and provides the necessary surface tension to operate efficiently. At the center of both roller assemblies is a threaded inner pin 31 that engages the hex screws 16, holds the rollers to the frame, and allows the rollers to spin freely.

One of the key features of the present invention is the groove 41 in the inserts 40, 42. The groove 41 on the takeup roller and feeder roller work in conjunction with the rubber band 38 and the tension control dial 28 to maintain the proper tension on the tape for an entire spool of tape. As the tape dispensing apparatus is used, the backing material accumulates on the takeup roller, changing the diameter of the takeup roller assembly. This increased diameter would cause the tape dispenser to malfunction because of the different revolutions-per-minute (RPM) differential between the takeup roller and the feeder roller. To compensate for this factor, the depth of the takeup roller groove is greater than the depth of the feeder roller. This creates a smaller diameter dimension on the takeup roller, slightly increasing the revolutions-per-minute (RPM) differential on the takeup roller and keeping the tape taut. The groove 41 feature works in conjunction with the size of the rubber band 38 and determines the amount of slip over the guide roller to compensate for the difference in diameter as the unit is used and the diameter of the takeup roller increases.

A simple variation of the groove is to utilize two different size inserts for the takeup roller and the feeder roller so that the dimensions correspond to the proper rate differential necessary for the invention to function. Another variation changes the rubber sleeve dimension, changing the rate at which the backing material accumulates on the takeup roller. The present invention contemplates changes to the rubber band, the takeup roller insert, the feeder roller insert, the takeup roller rubber sleeve, and the feeder roller rubber sleeve, any of which can accomplish the same function of changing the RPM differential between the takeup roller and the feeder roller.

The guide roller 32 is made of plastic in the preferred embodiment. The roller has a threaded pre-molded portion on each side for accepting the hex screws from the side panel and front panel that hold the roller in place. A metallic sleeve maintains the roller in place and allows the roller to spin freely.

Figure 8:
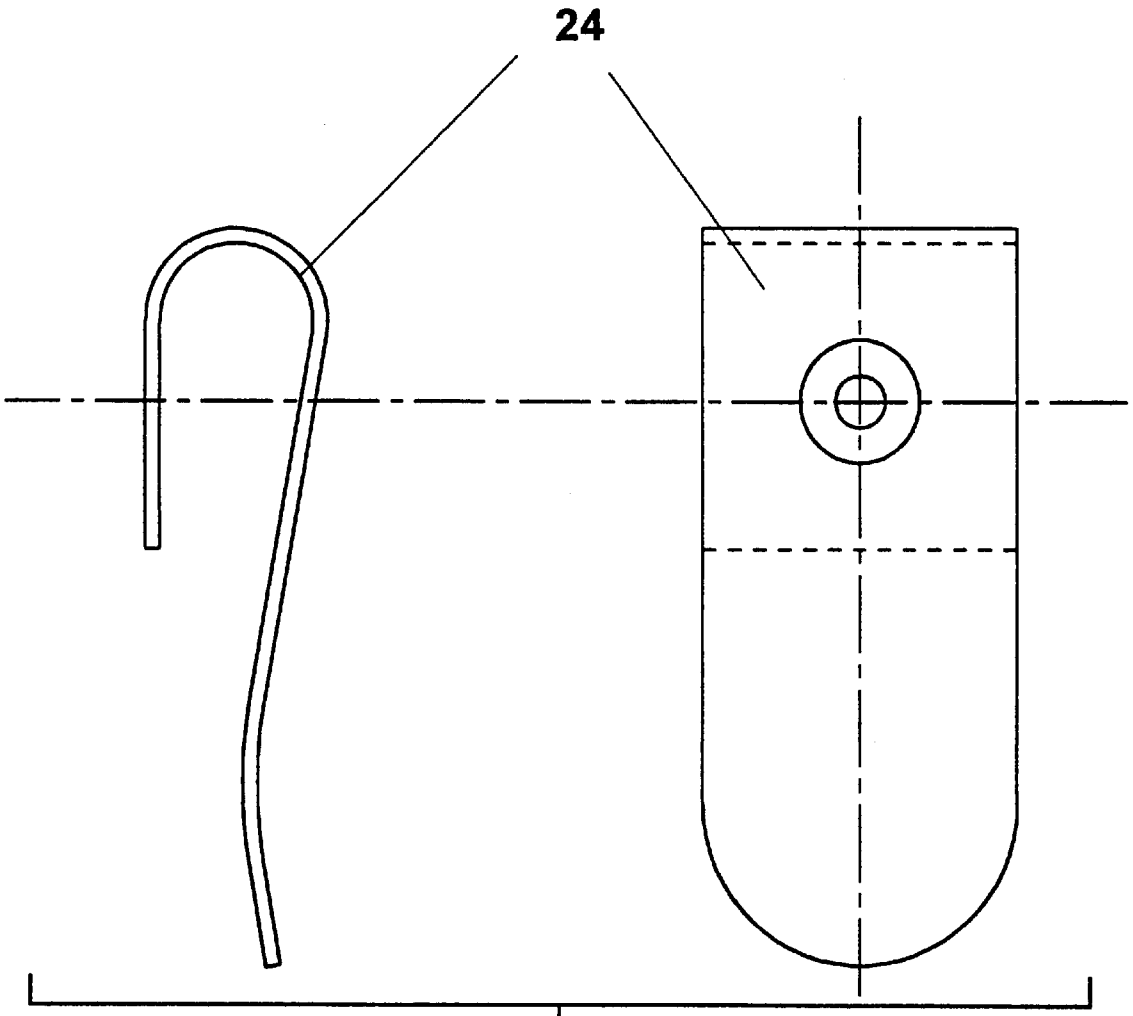
FIG. 8 is a side and front view of the belt mountable hook.

The guide roller accepts the adhesive backed tape with the backing material and provides the necessary positioning of the tape so that the takeup roller and feeder roller can properly separate the tape into the two components—the adhesive backed tape, and the backing material. The backing material collects on the takeup roller, and the adhesive backed tape is made available to the user. In the preferred embodiment, The belt mountable hook 24 is depicted in FIG. 8, and shows the shape and structure of the belt hook 24. The hook 24 clips easily onto a belt or work apron and allows the user to move freely with both hands free. The dispenser is easily removed from the belt or work apron by a gentle upward force. The dispenser can also be mounted to a belt hook receiver shown in FIG. 11.

Figure 9:
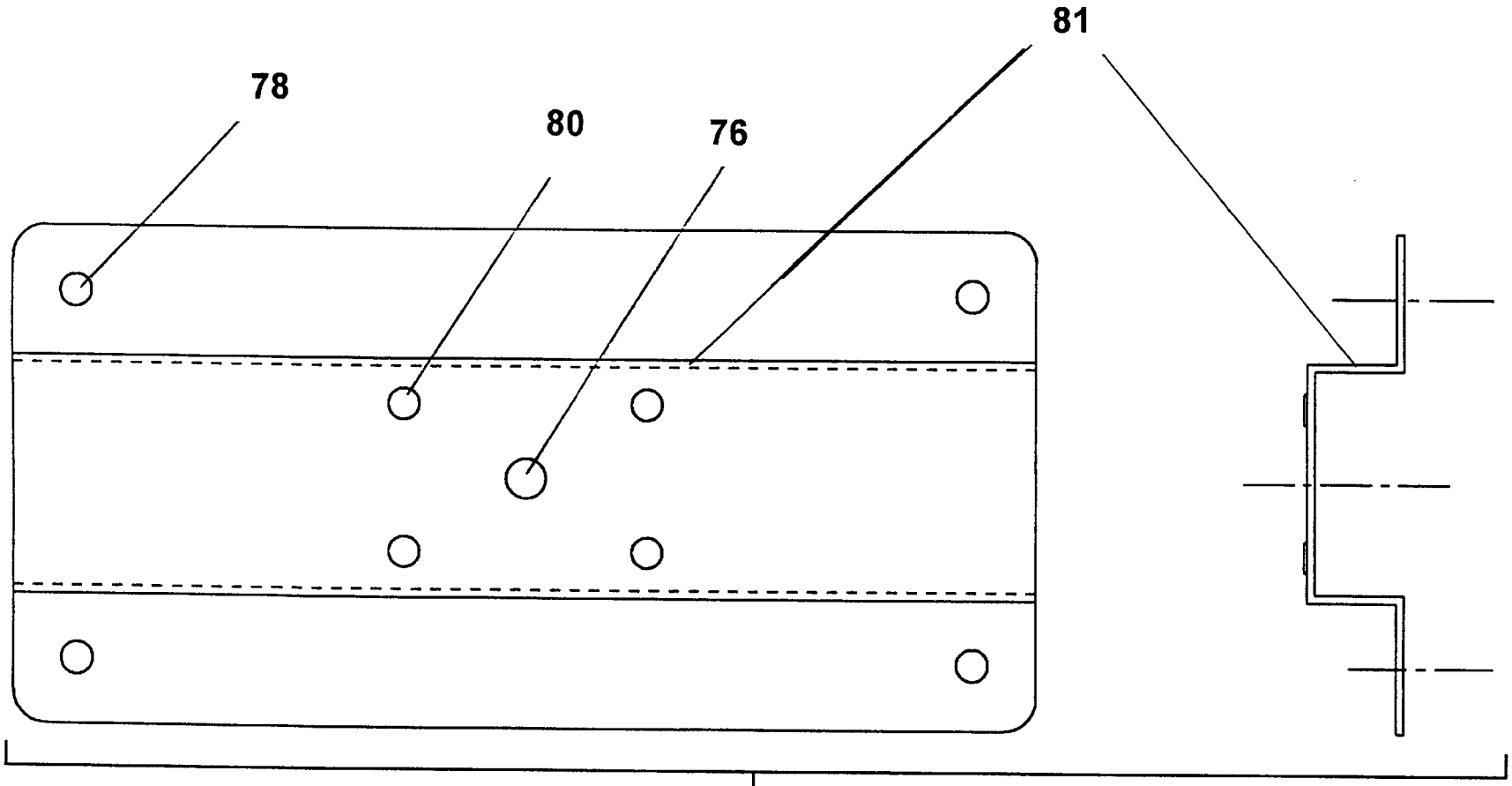
FIG. 9 depicts a top and side view of the surface mount platform.

In FIG. 9, the surface mount platform is depicted. The platform is secured to a stable base area by securing screws, nails, or similar fasteners into the mounting holes 78. The platform has a raised portion 81 that is designed to engage the dispenser assembly once the handle 6 is removed. A center guide hole 76 is used to secure the dispenser to the platform bar using standard nut and bolt hardware. The guide holes 78 ensure the unit is seated properly, and prevents the unit from twisting or turning during operation.

Figure 10A:
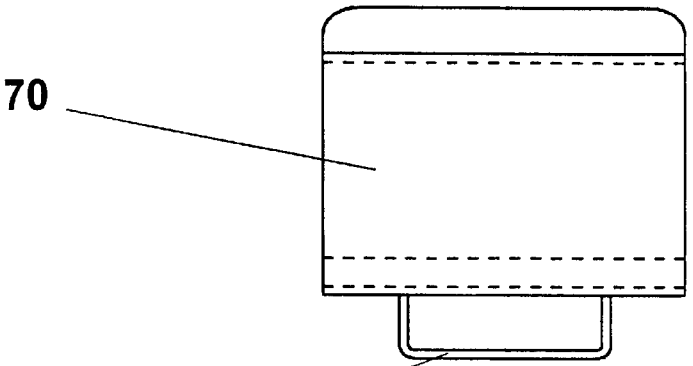
FIG. 10A shows a top view of a frame mounting assembly.
Figure 10B:
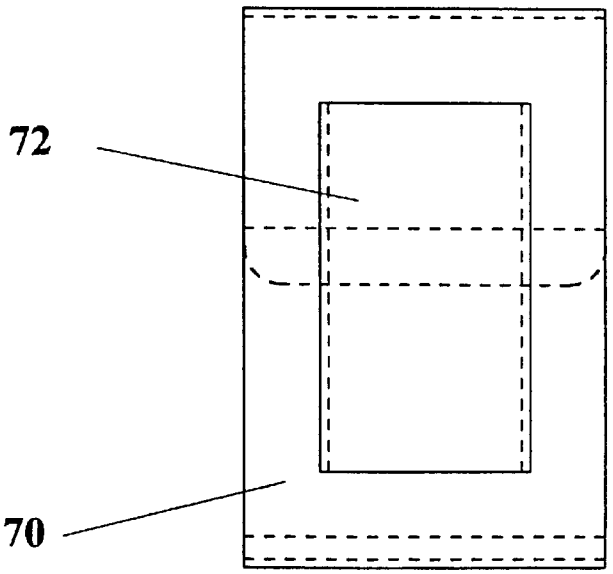
FIG. 10B shows a front view of a frame mounting assembly.
Figure 10C:
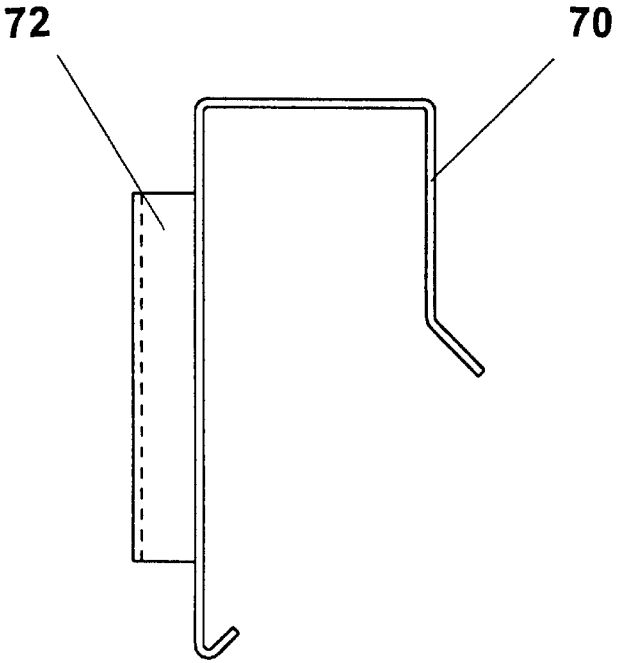
FIG. 10C shows a side view of a frame mounting assembly.

The frame mount is shown in FIG. 10. The inner tab of the belt hook 24 is substantially straight, and is designed to fit into the rafter mount of FIG. 10. The belt hook 24 fits snugly into the tab receptacle 72 and holds the dispenser in a stationary position when the rafter mount 70 is fixed in place. The frame mount is designed to slip a section of framing lumber or similar construction material. In the preferred embodiment, the mount is designed to accept the width of approximately 1¾ inches, which is the industry width for a two-inch width piece of lumber. This mount will accept 2×4, 2×6, 2×8, 2×10 and 2×12 lumber stock. The curved receiving portion of the mount 74 provides the necessary force to hold the mount in place.

Once the rafter mount is in place, the dispenser can be secured into the tab receptacle 72, thus providing a stationary dispensing unit. Users can then withdraw the desired length of foil tape and easily tear the tape with the cutting assembly. The frame or rafter mount is specifically constructed to permit the operator to easily and quickly move the mount. In this embodiment the handle can remain attached to the dispenser, although it can easily be removed if required.

Figure 11A:
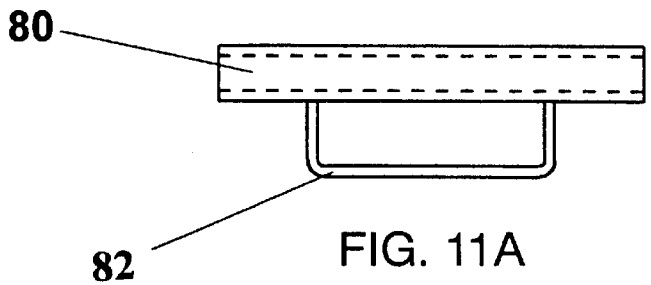
FIG. 11A shows a side perspective of a belt hook receiver assembly.
Figure 11B:
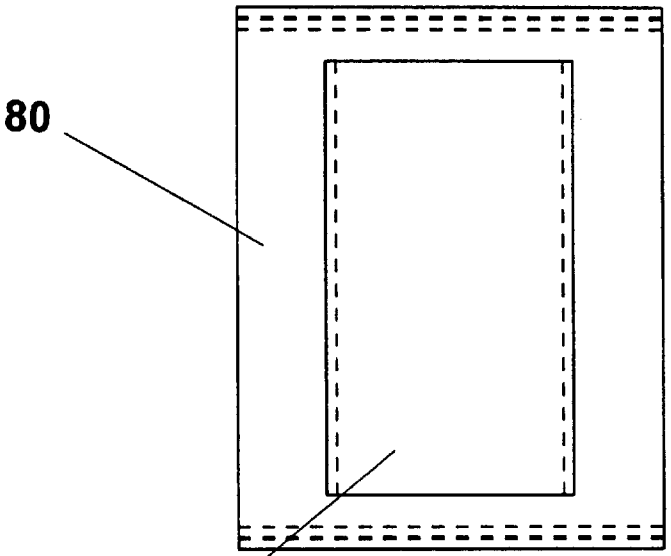
FIG. 11B shows a top view of a belt hook receiver assembly.
Figure 11C:
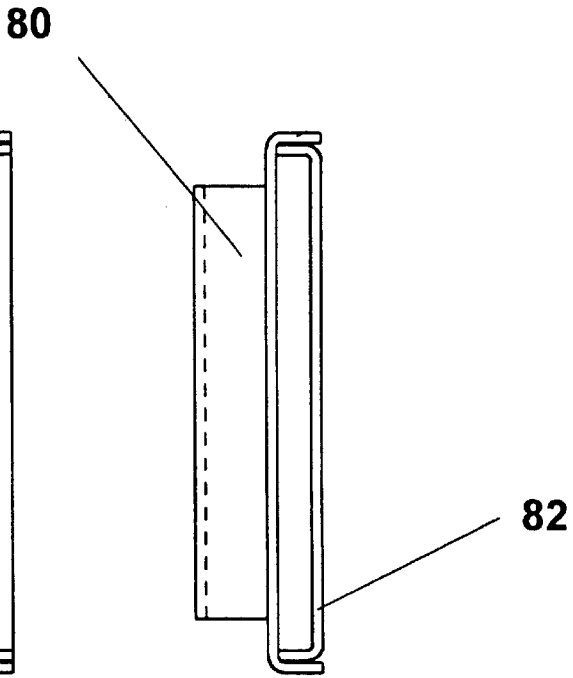
FIG. 11C shows a top view of a belt hook receiver assembly.

In FIG. 11, the belt hook receiver is illustrated. The operator feeds a belt through the belt fastening opening 80, and secures the belt to the operator. The tape dispenser hook 24 fits securely into the belt receiver portion 82 and holds the dispenser in place until use.

In operation, the access panel knob 26 is unscrewed from the access panel receptacle 25. The access panel 4 is opened, and a spool of foil tape is placed over the supply reel 10 so that the tape dispenses rotates in a counter-clockwise motion as the tape is dispensed. The access panel is then closed and the panel knob tightened. The operator reaches in from the front opening and feeds the foil tape over the guide roller 32 and under the feeder roller assembly 34. Peeling back the protective backing, the operator affixes the backing material to the takeup roller. In the preferred embodiment the operator uses a small piece of the adhesive tape to secure the backing material to the takeup roller. Other variations on securing the backing material to the takeup roller include using pins, posts, securing slits and similar means.

The foil tape with the adhesive layer exposed on the underside is drawn around the feeder roller and can be fastened to the cutting assembly. As the operator pulls on the adhesive exposed foil tape, the supply reel rotates counterclockwise, allowing the foil tape to be drawn to the guide roller. As the tape proceeds from the guide roller, the backing is automatically drawn to the takeup roller, while the foil tape is presented to the operator. When the desired length has been removed, the operator moves the foil tape towards the cutting assembly, where the serrated cutting edge tears the tape.

The takeup roller and the feeder roller are the same dimension at the outer rubber sleeve, although the groove in the insert is greater on the takeup roller. By selecting the correct rubber band and the corresponding groove depths, the tape dispenses evenly throughout the entire roll of tape without fouling. The foil tape is dispensed at the same rate as the backing material is drawn to the takeup roller. Both rollers rotate in a clockwise direction as a result of the force exerted by the operator pulling the foil tape. The guide directs the flow of the foil tape and prepares the tape for the backing separation process.

The tension dial is adjusted to maintain the correct amount of pressure on the tape to ensure that the tape is kept taut, but can be drawn out evenly. By turning the dial clockwise, the tension on the spring increases, making it more difficult to pull out lengths of tape. It is necessary to maintain some level of tension to keep the tape spool from spinning freely and fouling the tape. The tension dial allows the operator to adjust the tension to the proper level. Because the tape spools are all an industry standard size, the tension does not require frequent adjustment.

When the tape spool is empty, the backing material can be disposed of by pulling the material off of the takeup spool and into a garbage dispenser. The backing material is thusly efficiently and quickly dispensed without requiring cleaning up small pieces of backing material from the worksite. As described herein, a worksite is merely the area around which the tape is being used and does not necessarily refer to a commercial environment.

The foregoing description of the preferred embodiment of the invention has been presented for the purpose of illustration and description. It is not intended to be exhaustive or to limit the invention to the precise form disclosed. Many modifications and variations are possible in light of the above teachings. It is intended that the scope of the invention be limited not by this detailed description, but rather by the claims appended hereto.

The invention is susceptible of many variations, all within the scope of the claims. The preferred embodiment described here and illustrated in the figures should not be construed as in any way limiting.

No warranty is expressed or implied as to the actual degree of safety, security or support of any particular specimen of the invention in whole or in part, due to differences in actual production designs, materials and use of the products of the invention.

I claim:

1. A dispensing apparatus for adhesive tape with protective backing, comprising:

a frame;

a supply reel rotatably mounted to said frame, wherein said supply reel accepts a spool of tape;

a guide roller rotatably mounted to said frame, wherein said guide roller accepts a section of tape from said spool;

a feeder roller rotatably mounted to said frame, wherein said feeder roller accepts said section of tape, and wherein said protective backing separates from said section of tape;

a takeup roller rotatably mounted to said frame for receiving said protective backing; and a rubber band drive connecting said feeder roller with said takeup roller.

2. A dispensing apparatus as in claim 1, wherein said supply reel has a means of tension control.

3. A dispensing apparatus as in claim 1, wherein said supply reel consists of an inner shaft assembly fixedly attached to said side panel, a shaft guide, a feeder spool, a washer, and a tension spring controlled by a tension dial.

4. A dispensing apparatus as in claim 1, wherein said frame has an access panel hingedly attached to said frame.

5. A dispensing apparatus as in claim 1, further comprising a handle attached to said frame.

6. A dispensing apparatus as in claim 5, wherein said handle is removable.

7. A dispensing apparatus as in claim 1, further comprising a cutting blade connected to said frame.

8. A dispensing apparatus as in claim 7, wherein said cutting blade is adjustable.

9. A dispensing apparatus as in claim 1, wherein said takeup roller and said feeder roller have a rubber outer surface.

10. A dispensing apparatus as in claim 1, further comprising a belt mountable hook attached to said frame.

11. A dispensing apparatus as in claim 10, wherein said belt mountable hook engages a rafter mount to fixedly attach said dispenser.

12. A dispensing apparatus as in claim 1, wherein said dispenser engages a surface mount platform.

13. A dispensing apparatus as in claim 1, wherein said dispenser is constructed from the group consisting of stainless steel, steel, aluminum, and plastic.

14. A dispensing apparatus as in claim 1, wherein said feeder roller is comprised of a threaded inner shaft, an insert surrounding said shaft, and a rubber sleeve encasing said insert, and wherein said takeup roller is comprised of a threaded inner shaft, an insert surrounding said shaft, and a rubber sleeve encasing said insert.

15. A dispensing apparatus as in claim 14, wherein said feeder roller insert has a groove and said takeup roller insert has a groove, wherein said rubber band is positioned in said feeder roller insert groove and in said takeup roller insert groove.

16. A dispensing apparatus as in claim 15, wherein said takeup roller insert groove is deeper than said feeder roller insert groove.

* * * * *